US009365999B1

(12) United States Patent
Jordan et al.

(10) Patent No.: US 9,365,999 B1
(45) Date of Patent: Jun. 14, 2016

(54) METHOD OF INSTALLING A HOUSING FOR AN INGROUND VEHICLE LIFT

(71) Applicant: VEHICLE SERVICE GROUP, LLC, Madison, IN (US)

(72) Inventors: Adam Jordan, Madison, IN (US); Paul Lee, Madison, IN (US); Jon Martin, Roseville, CA (US)

(73) Assignee: Vehicle Services Group, LLC, Madison, IN (US)

( * ) Notice: Subject to any disclaimer, the term of this patent is extended or adjusted under 35 U.S.C. 154(b) by 0 days.

(21) Appl. No.: 14/535,525

(22) Filed: Nov. 7, 2014

Related U.S. Application Data

(60) Provisional application No. 61/903,132, filed on Nov. 12, 2013.

(51) Int. Cl.

| | |
|---|---|
| ***B66F 7/00*** | (2006.01) |
| ***E02D 27/50*** | (2006.01) |
| ***E04B 1/16*** | (2006.01) |
| ***E04B 1/41*** | (2006.01) |
| ***E04B 1/58*** | (2006.01) |
| ***E04B 1/62*** | (2006.01) |
| ***E04C 5/01*** | (2006.01) |
| ***E04C 5/16*** | (2006.01) |

(52) U.S. Cl.
CPC . *E02D 27/50* (2013.01); *B66F 7/00* (2013.01); *E04B 1/16* (2013.01); *E04B 1/41* (2013.01); *E04B 1/58* (2013.01); *E04B 1/62* (2013.01); *E04C 5/01* (2013.01); *E04C 5/162* (2013.01)

(58) Field of Classification Search
CPC ..... E02D 27/50; E04B 1/16; E04B 1/41; E04B 1/58; E04B 1/62; E04C 5/01; E04C 5/162; B66F 7/00
USPC ..... 52/741.11, 741.15; 187/203, 205; 254/1, 89 R
See application file for complete search history.

(56) References Cited

U.S. PATENT DOCUMENTS

| | | | | | |
|---|---|---|---|---|---|
| 3,385,015 | A * | 5/1968 | Hadley | E04C 3/294 | 264/228 |
| 3,705,469 | A * | 12/1972 | Eriksson | B28B 23/005 | 249/66.1 |
| 3,882,585 | A * | 5/1975 | Costes | B23P 11/00 | 29/452 |
| 4,997,314 | A * | 3/1991 | Hartman | E02D 7/20 | 405/233 |
| 5,131,790 | A * | 7/1992 | Simpson | E02D 5/38 | 405/229 |
| 5,228,807 | A * | 7/1993 | Willcox, Jr. | E02D 5/60 | 405/232 |
| 5,259,702 | A * | 11/1993 | Simpson | E02D 5/38 | 405/229 |
| 5,713,701 | A * | 2/1998 | Marshall | E02D 5/30 | 405/232 |
| 6,390,734 | B1 * | 5/2002 | Marshall | E02D 35/00 | 405/230 |

(Continued)

*Primary Examiner* — James Buckle, Jr.
(74) *Attorney, Agent, or Firm* — Frost Brown Todd LLC

(57) ABSTRACT

A method of installing an inground vehicle lift includes the steps of excavating an area to create a pit, lowering a housing which encloses the mechanical components of the lift into the pit via a support structure, coupling the housing with a lower rebar system and an upper rebar system via a plurality of anchors and a plurality of angled support members before or after lowering the housing into the pit, leveling the housing, pouring concrete into the pit to a level such that the lower rebar system is sufficiently embedded within the concrete, allowing the concrete to partially cure, detaching the housing from the support structure, backfilling the pit with backfill material, installing insulation within the pit above the backfill material, and pouring concrete into the pit to a level such that the upper rebar system is sufficiently embedded within the concrete.

20 Claims, 12 Drawing Sheets

(56) References Cited

U.S. PATENT DOCUMENTS 6,539,685 B2 * 4/2003 Bell ..... E02D 35/00 405/229
6,634,830 B1 * 10/2003 Marshall ..... E02D 5/30 403/368
6,923,599 B2 * 8/2005 Kelso ..... E02D 35/00 187/203
8,171,678 B2 * 5/2012 Stanford ..... E02D 35/00 52/125.5
8,458,984 B2 * 6/2013 Marshall ..... E02D 27/32 405/229
8,978,343 B1 * 3/2015 Sandor ..... B66C 1/666 414/10
2007/0028557 A1 * 2/2007 Kelly ..... E02D 27/34 52/741.15
2009/0211178 A1 * 8/2009 Marshall ..... E02D 27/01 52/126.6
2011/0056150 A1 * 3/2011 Marshall ..... E02D 35/00 52/125.1

* cited by examiner

METHOD OF INSTALLING A HOUSING FOR AN INGROUND VEHICLE LIFT

BACKGROUND

Inground vehicle lifts are well known within the automotive maintenance and repair industry. An example of one such lift, specifically the MOD30 heavy-duty inground lift manufactured and sold by Vehicle Service Group, is shown in FIG. 1. As shown, the lift 10 includes a front housing 20 and a rear housing 30 that are each recessed into a floor 5. Each housing 20, 30 encloses the mechanical components required to operate the respective front jack 22 and rear jack 32 in each housing. Various methods of recessing the housings 20, 30 into an existing floor 5 have been used in the past. For example, in one such method a pit is excavated, the housing 20, 30 is suspended within the pit, a backfill material, such as pea gravel or dirt, is poured into the pit to surround the housing, and, finally, the housing is connected to the existing floor 5 using concrete and rebar. In this method, the housing 20, 30 is not supported along its bottom surface. Instead, the housing 20, 30 is only supported by its connections to the existing floor 5. In another method, a pit is excavated, a concrete slab or pad is poured in the bottom of the pit, then, once the slab has fully cured, the housing 20, 30 is positioned within the pit on top of the slab and the housing 20, 30 is anchored to the slab and leveled relative to the existing floor 5 surrounding the pit. Once the housing 20, 30 has been anchored and leveled, then a backfill material is poured into the pit around the housing 20, 30 and the housing 20, 30 is connected to the existing floor 5 using concrete and rebar.

While a variety of methods of installing housings for inground vehicle lifts have been used, it is believed that no one prior to the inventors has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which:

FIG. 7A is a detailed view of a leveling bolt and leveling gusset of the front housing of FIG. 7;

FIG. 7B is a detailed view of a support member of the front housing of FIG. 7 after the top layer of concrete has been poured;

Figure 1:
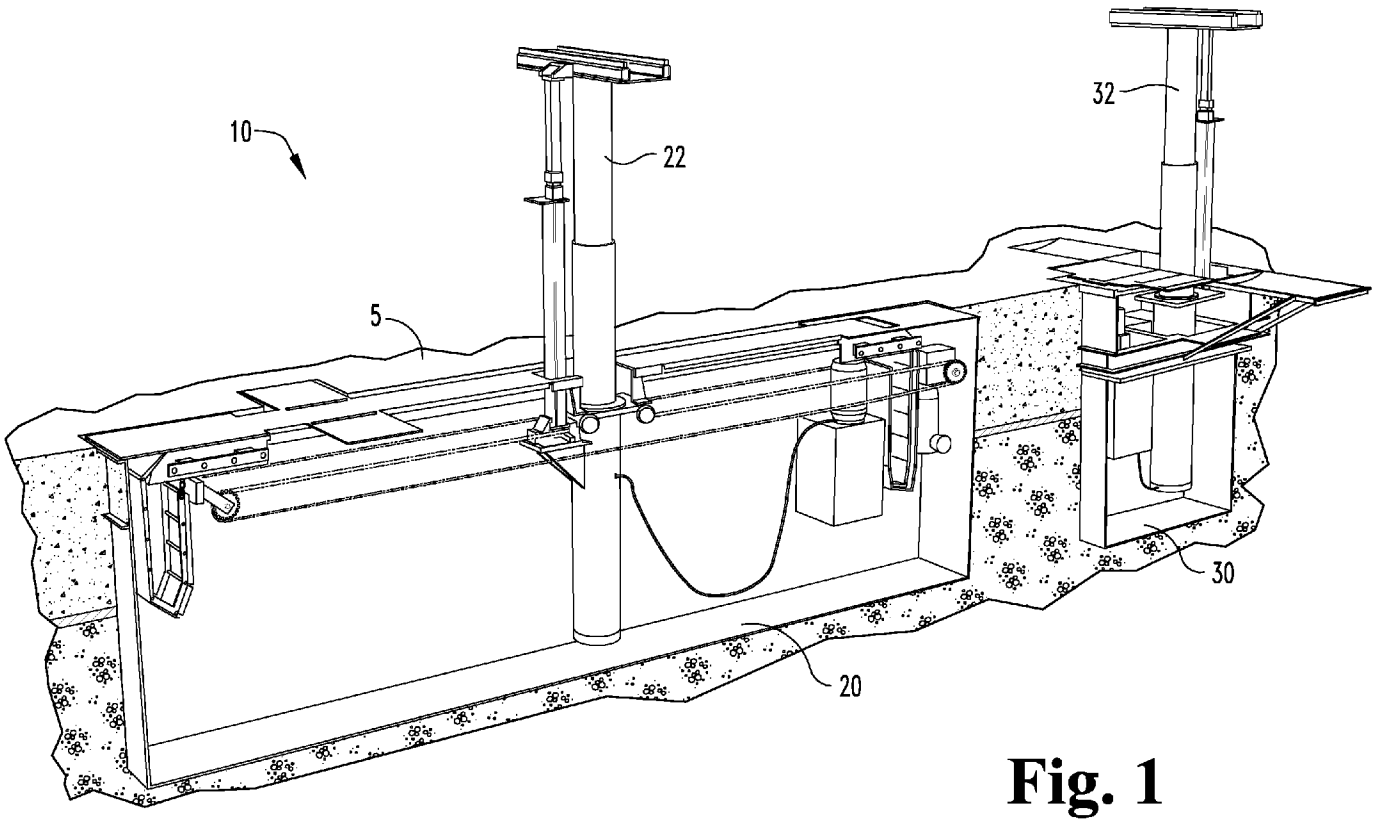
Fig. 1 PRIOR ART
FIG. 1 depicts a perspective, cross-sectional view of an exemplary inground lift.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

The lift system 10 described herein and shown in FIGS. 1-5 depicts an example of a lift system comprising two housings. However, the lift system may be configured in various ways and still make use of the installation method described herein. For instance, the housing designated as "front" may be installed in the "rear" position within the lift service bay, and vice versa. Also, the lift system may comprise more than two housings consisting of any various combination of housings designated "front" and "rear", according to the preference of the lift bay architect or designer.

Figure 2:
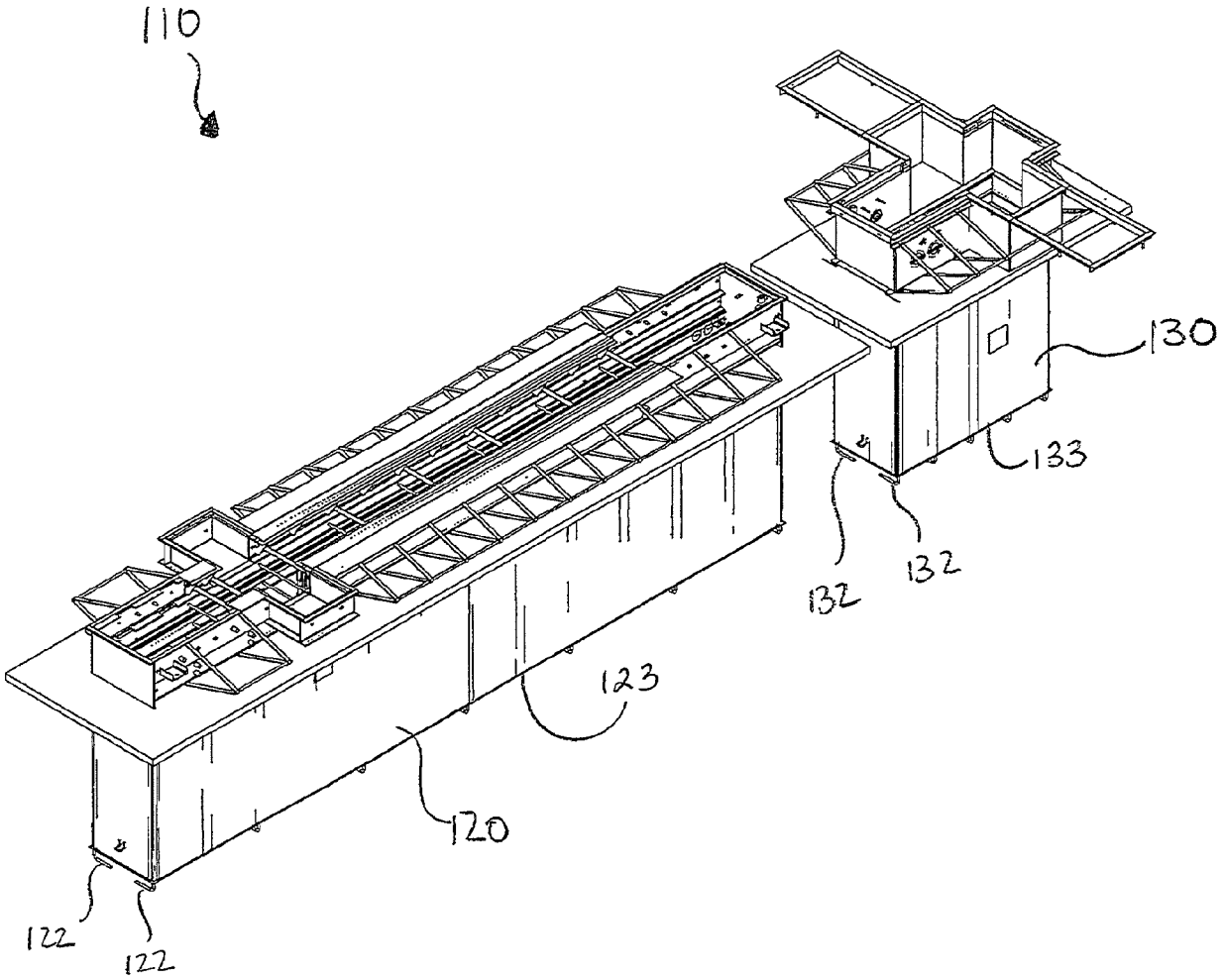
FIG. 2 depicts a top perspective view of a pair of housings operable for use with the inground lift of FIG. 1.
Figure 3:
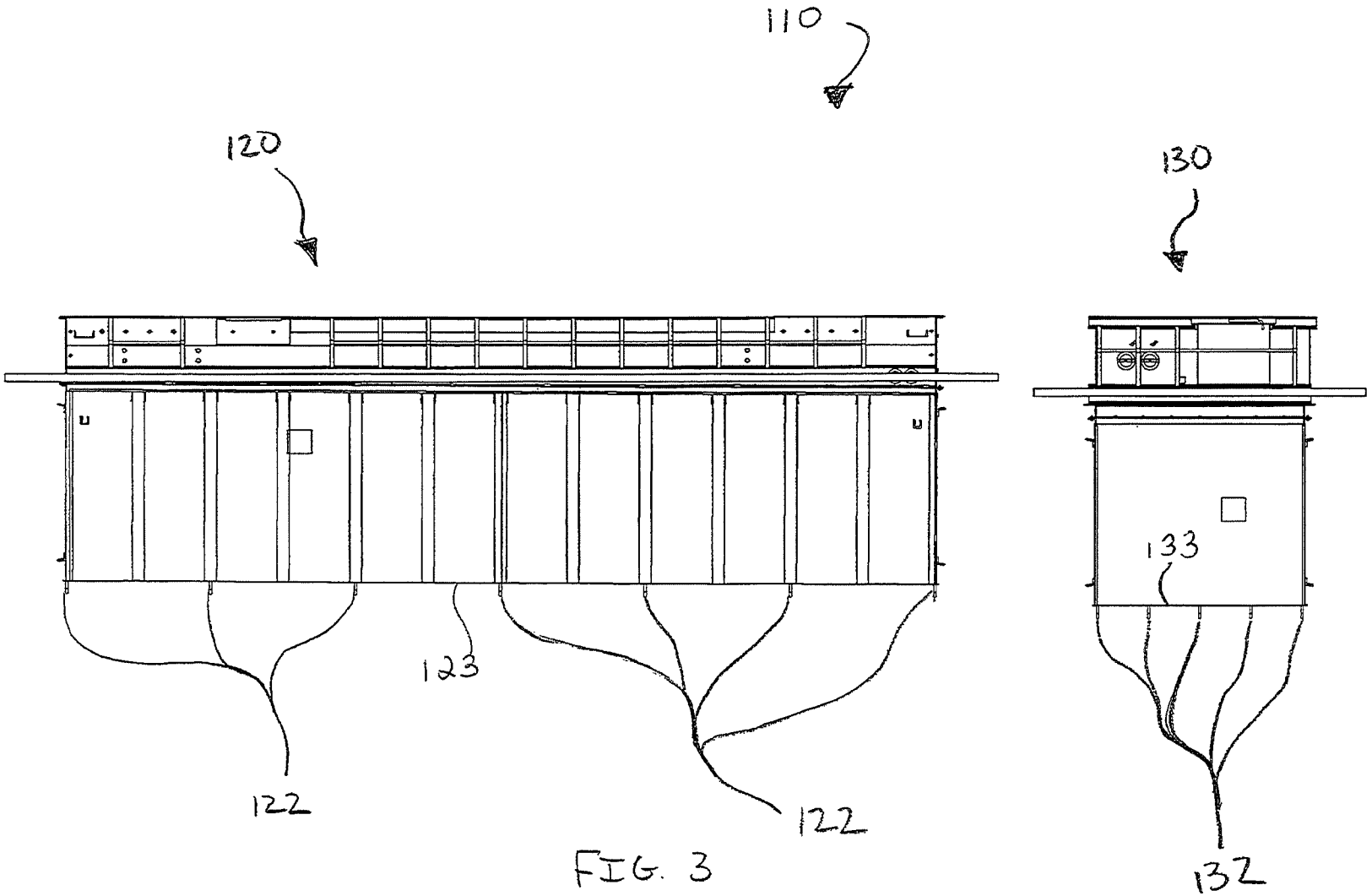
FIG. 3 depicts a side plan view of the housings of FIG. 2.

FIGS. 2-3 illustrate exemplary housings 110 operable for use with inground lift 10. Housings 110 include a front housing 120 and a rear housing 130. Similar to inground lift 10 shown in FIG. 1 and described above, front housing 120 and rear housing 130 are configured to be placed within an excavated cavity and recessed within a floor. As shown, front housing 120 includes a series of rebar anchors 122 attached to a bottom surface 123 of front housing 120. In other embodiments, the rebar anchors 122 may extend from a side surface of the front housing 120, instead of from the bottom surface 123. In the illustrated embodiment, rebar anchors 122 are arranged in pairs with opposing rebar anchors positioned along the outside edges of the bottom surface 123. In addition, as shown, rebar anchors 122 are L-shaped. It will be appreciated that rebar anchors 122 may comprise any shape suitable to engage the lower rebar system 140 (described below). Similarly, other embodiments may include any number of rebar anchors arranged in any configuration suitable to provide sufficient engagement between the front housing 120 and the lower rebar system 140. As shown, the front housing 120 also includes a series of angled support members 124 positioned along an upper portion of the front housing 120. Support members 124 provide anchoring similar to rebar anchors 122. In this embodiment, the support members 124 are triangularly shaped. It will be appreciated that, similar to the rebar anchors 122 discussed above, the support members 124 may comprise any shape, number and/or configuration suitable to adequately engage the upper rebar system 160 (described below).

Rear housing 130 also includes a series of rebar anchors 132 attached to a bottom surface 133 of rear housing 130. In other embodiments, the rebar anchors 132 may extend from a side surface of the rear housing 130, instead of from the bottom surface 133. Similar to rebar anchors 122, in the illustrated embodiment, rebar anchors 132 are arranged in pairs with opposing rebar anchors positioned along the outside edges of the bottom surface 133. In addition, as shown, rebar anchors 132 are also L-shaped. It will be appreciated that rebar anchors 132 may comprise any shape suitable to engage the lower rebar system 150 (described below). Similarly, other embodiments may include any number of rebar anchors arranged in any configuration suitable to provide sufficient engagement between the rear housing 130 and the lower rebar system 150. As shown, the rear housing 130 also includes a series of angled support members 134 positioned along an upper portion of the front housing 130. Support members 134 provide anchoring similar to rebar anchors 132. In this embodiment, the support members 134 are triangularly shaped. It will be appreciated that, similar to the rebar anchors 132 discussed above, the support members 134 may comprise any shape, number and/or configuration suitable to adequately engage the upper rebar system 170 (described below).

Figure 4:
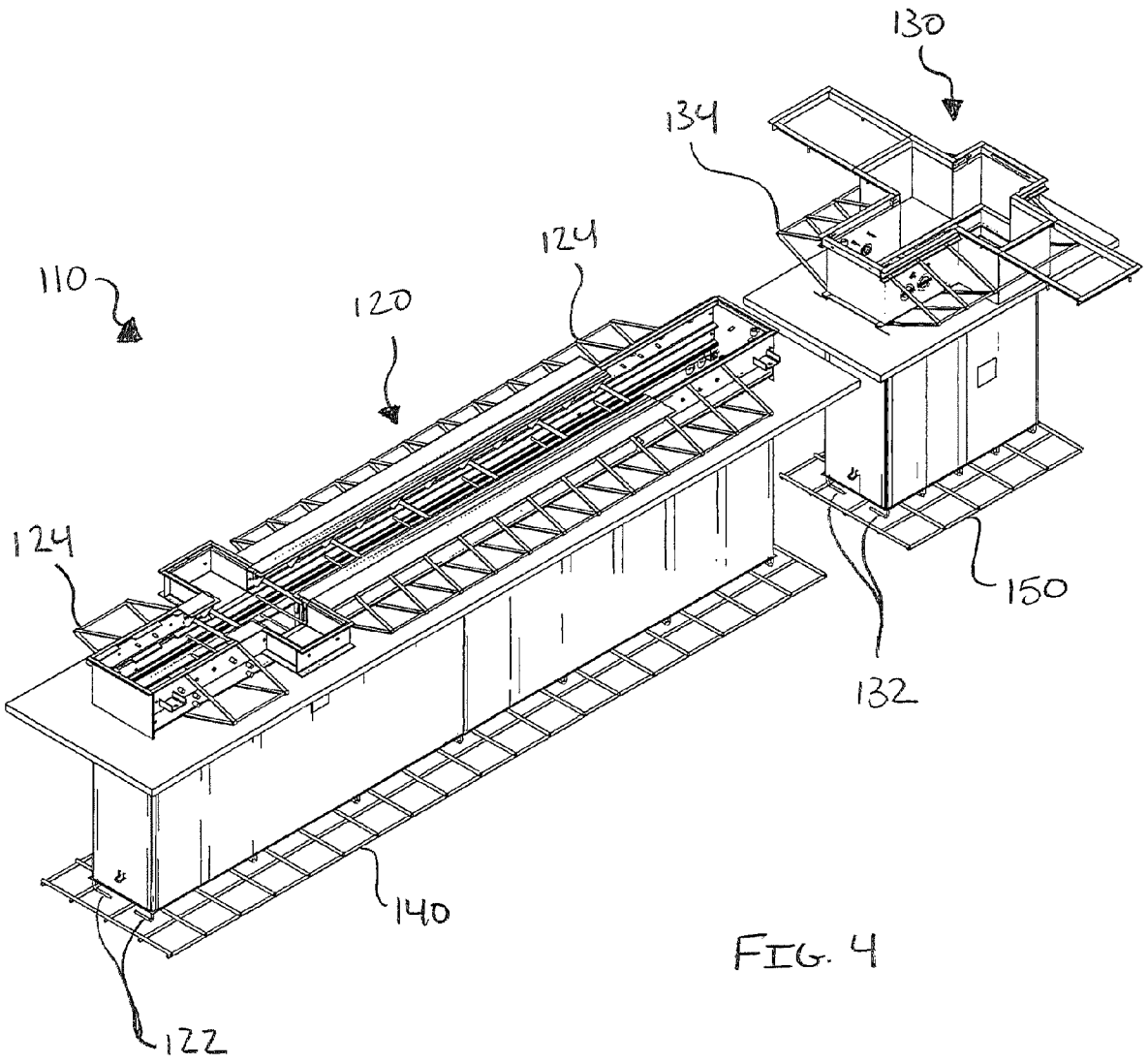
FIG. 4 depicts a top perspective view of the housings of FIG. 2 with a lower rebar system positioned below the housings.

As shown in FIG. 4, a lower rebar system 140 is positioned beneath the front housing 120. As described in more detail below, the lower rebar system 140 may be embedded within a concrete slab in order to help support the front housing 120 when it is installed in a floor. In the illustrated embodiment, lower rebar system 140 comprises a series of rebar members arranged in a grid pattern. It will be appreciated that lower rebar system 140 may comprise any configuration suitable to adequately engage rebar anchors 122 and help provide sufficient support to the front housing 120.

Similarly, another lower rebar system 150 is positioned beneath the rear housing 130. As described in more detail below, the lower rebar system 150 may be embedded within a concrete slab in order to help support the rear housing 130 when it is installed in a floor. In the illustrated embodiment, lower rebar system 150 comprises a series of rebar members arranged in a grid pattern. It will be appreciated that lower rebar system 150 may comprise any configuration suitable to adequately engage rebar anchors 132 and help provide sufficient support to the rear housing 130.

Figure 5:
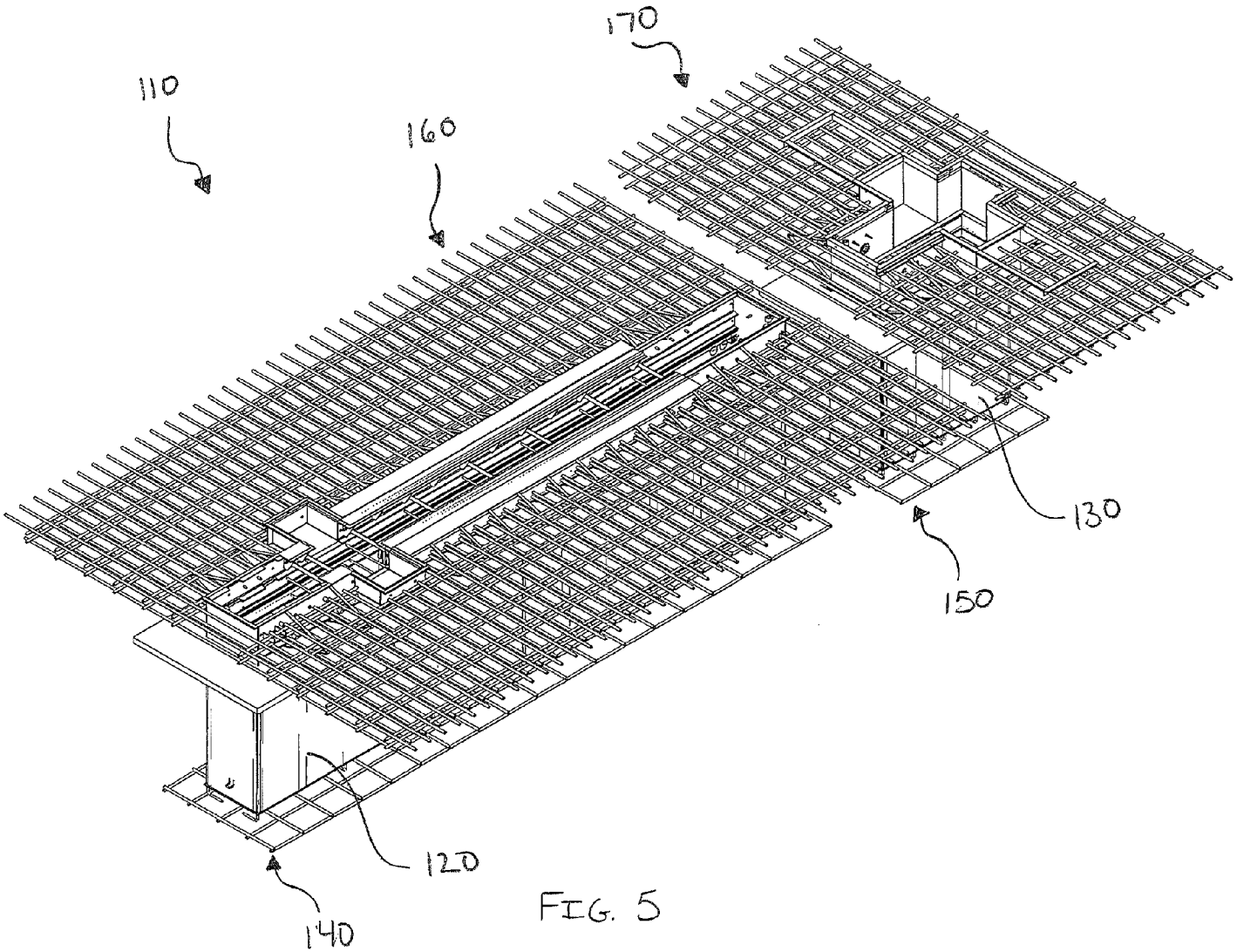
FIG. 5 depicts a top perspective view of the housings of FIG. 2 with an upper rebar system positioned above the housings and a lower rebar system positioned below the housings.

As shown in FIG. 5, an upper rebar system 160 engages an upper portion of the front housing 120. In this embodiment, the upper rebar system 160 surrounds the upper portion of the front housing 120 and a portion of the upper rebar system 160 passes through the support members 124 positioned along an upper portion of the front housing 120. As described in more detail below, the upper rebar system 160 may be used to connect the front housing 120 to the existing floor. As part of that connection process, which is described in more detail below, the upper rebar system 160 may be embedded in concrete poured on top of the backfill material and rigid insulation to surround the upper portion of the front housing 120 and fill in the pit containing the front housing 120. In the illustrated embodiment, upper rebar system 160 comprises a series of rebar members arranged in a grid pattern. It will be appreciated that upper rebar system 160 may comprise any configuration suitable to adequately connect the front housing 120 to the existing floor.

Similarly, another upper rebar system 170 is positioned adjacent to the upper edge of the rear housing 130. In this embodiment, the upper rebar system 170 surrounds the upper portion of the rear housing 130 and a portion of the upper rebar system 170 passes through the support members 134 positioned along an upper portion of the rear housing 130. As described in more detail below, the upper rebar system 170 may be used to connect the rear housing 130 to the existing floor. As part of that connection process, which is described in more detail below, the upper rebar system 170 may be embedded in concrete poured on top of the backfill material and rigid insulation to surround the upper portion of the rear housing and fill in the pit containing the rear housing 130. In the illustrated embodiment, upper rebar system 170 comprises a series of rebar members arranged in a grid pattern. It will be appreciated that upper rebar system 170 may comprise any configuration suitable to adequately connect the rear housing 130 to the existing floor.

Figure 6:
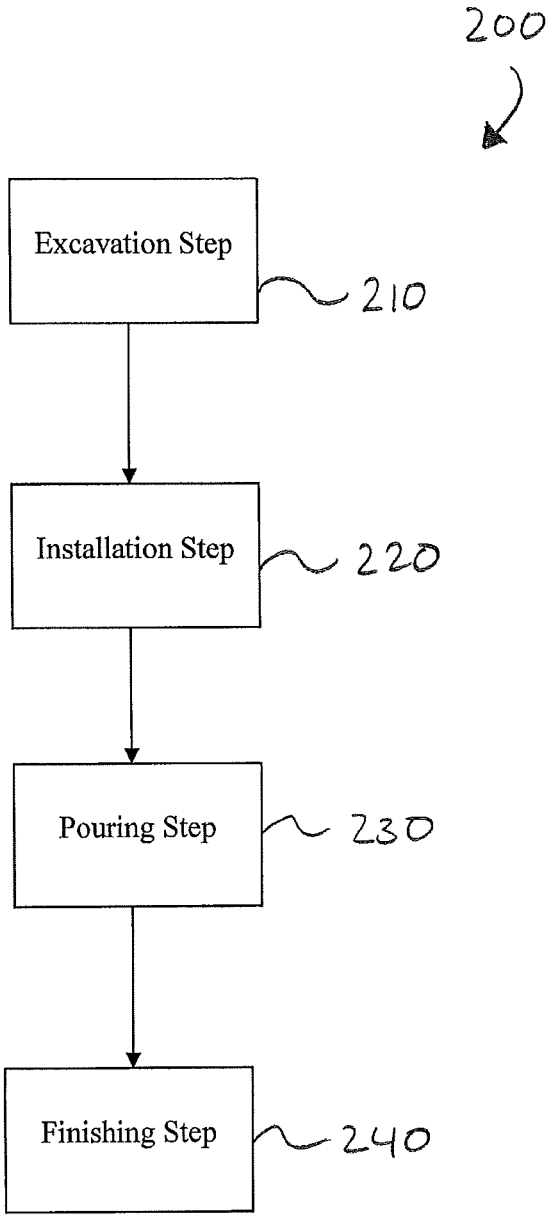
FIG. 6 is a flow chart depicting the steps in an exemplary method of installing the housings of FIG. 2.

FIG. 6 is a flow chart depicting an exemplary housing installation method 200 that can be used to install a housing for an inground vehicle lift, such as front housing 120 and rear housing 130, so that the housing is recessed within an existing floor. As shown, housing installation method 200 comprises an excavation step 210, an installation step 220, a pouring step 230 and a finishing step 240. During the excavation step 210, a pit or cavity is created in an existing floor. The pit is sized to receive the designated housing so that the upper edge of the housing can be leveled with the existing floor. The pit may be created using any suitable type of digging or excavation equipment.

Once the pit has been dug and the excavation step 210 has been completed, then the installation step 220 can begin. During the installation step 220, the housing is placed in the pit and suspended above the bottom of the pit. A lower rebar system, such as lower rebar systems 140, 150, may be positioned on the bottom surface of the pit prior to suspending the housing within the pit. If a lower rebar system is positioned on the bottom surface of the pit before the housing is suspended within the pit, then once the housing is suspended within the pit, then the rebar anchors attached to the bottom of the housing, such as rebar anchors 122, 132, are attached to the lower rebar system. In some cases, the rebar anchors attached to the housing may be lowered into the pit so that the rebar anchors are adjacent to, but not attached to, the lower rebar system, and final mechanical connection is achieved through the ensuing concrete pour, which is done during the pouring step 230 described below. Alternatively, a lower rebar system, such as lower rebar systems 140, 150 may be attached to the housing via the rebar anchors, such as rebar anchors 122, 132, prior to the housing being suspended within the pit. In this embodiment of the method, once the pit is completed, then the housing, with the lower rebar system already attached to the housing via the rebar anchors is suspended within the pit. The housing may be suspended in such a way that the lower rebar system is positioned slightly above the bottom surface of the pit or, alternatively, the lower rebar system may rest on the bottom surface of the pit.

During the installation step 220, the housing may be suspended from a support structure, such as one or more I-beams that span the upper opening of the pit. Specifically, the housing may hang from leveling bolts that are used to adjust the upper edge of the housing to make that upper edge level with the existing floor. The housing may be leveled by tightening or loosening the leveling bolts thereby raising or lowering the upper edge of the housing as desired.

Once the housing has been leveled with the existing floor and the installation step 220 has been completed, then the pouring step 230 can begin. During the pouring step 230, while the housing is suspended from the support structure within the pit, concrete is poured around and beneath the housing into the pit. The poured concrete forms a slab at the bottom of the pit such that the lower rebar system and the rebar anchors extending from the housing are embedded within the slab. In some embodiments, a bottom portion of the housing may be embedded within the slab in addition to the lower rebar system and rebar anchors. Once the concrete slab has been poured to sufficiently embed the housing, lower rebar system, and/or the rebar anchors, then no additional anchoring is required.

After the pouring step 230 has been completed and the concrete slab at the bottom of the pit has partially cured, then the housing can be removed from the support structure and the finishing step 240 can begin. Because the housing has already been leveled with the existing floor and the housing has already been sufficiently anchored to the concrete slab during the pouring step, it is not necessary to wait for the concrete slab to fully cure before beginning the finishing step 240. In other words, the finishing step 240 can be completed once the concrete slab has partially cured. During the finishing step, the pit is filled in with various materials. First, a backfill material, such as dirt, pea gravel, or any other suitable filler, is poured into the pit around the housing. Once the backfill material reaches a predetermined level, then insulation material is placed around the housing on top of the backfill material. The amount of backfill material may be chosen so that the insulation material placed on top of the backfill material is flush with the upper level of soil surrounding the central portion of the pit that contains the housing. In some embodiments, the insulation material may comprise rigid insulation about 2 inches thick. In other embodiments, the insulation material may comprise polyurethane sheeting. In some embodiments, after the backfill material has been poured but prior to installation of the insulation material, the installer may compact the surface of the backfill material.

Finally, once the insulation material and backfill material have been positioned within the pit, then the housing is attached to the existing floor by pouring a top layer of concrete around the top of the housing and on top of the insulation material. The top layer of concrete fills in the pit and creates a substantially level surface with the existing floor. The upper rebar system is embedded within the top layer of concrete.

It will be appreciated that the housing installation method 200 described herein can be used to install either a front housing, such as front housing 120, or a rear housing, such as rear housing 130. If an entire inground lift comprising both a front housing and a rear housing, such as inground lift 10, is being installed, then at least a portion of the housing installation method 200 may be conducted simultaneously for both the front housing and the rear housing or at least a portion of the housing installation method 200 may be conducted sequentially with either the front housing or the rear housing being installed first.

Figure 7:
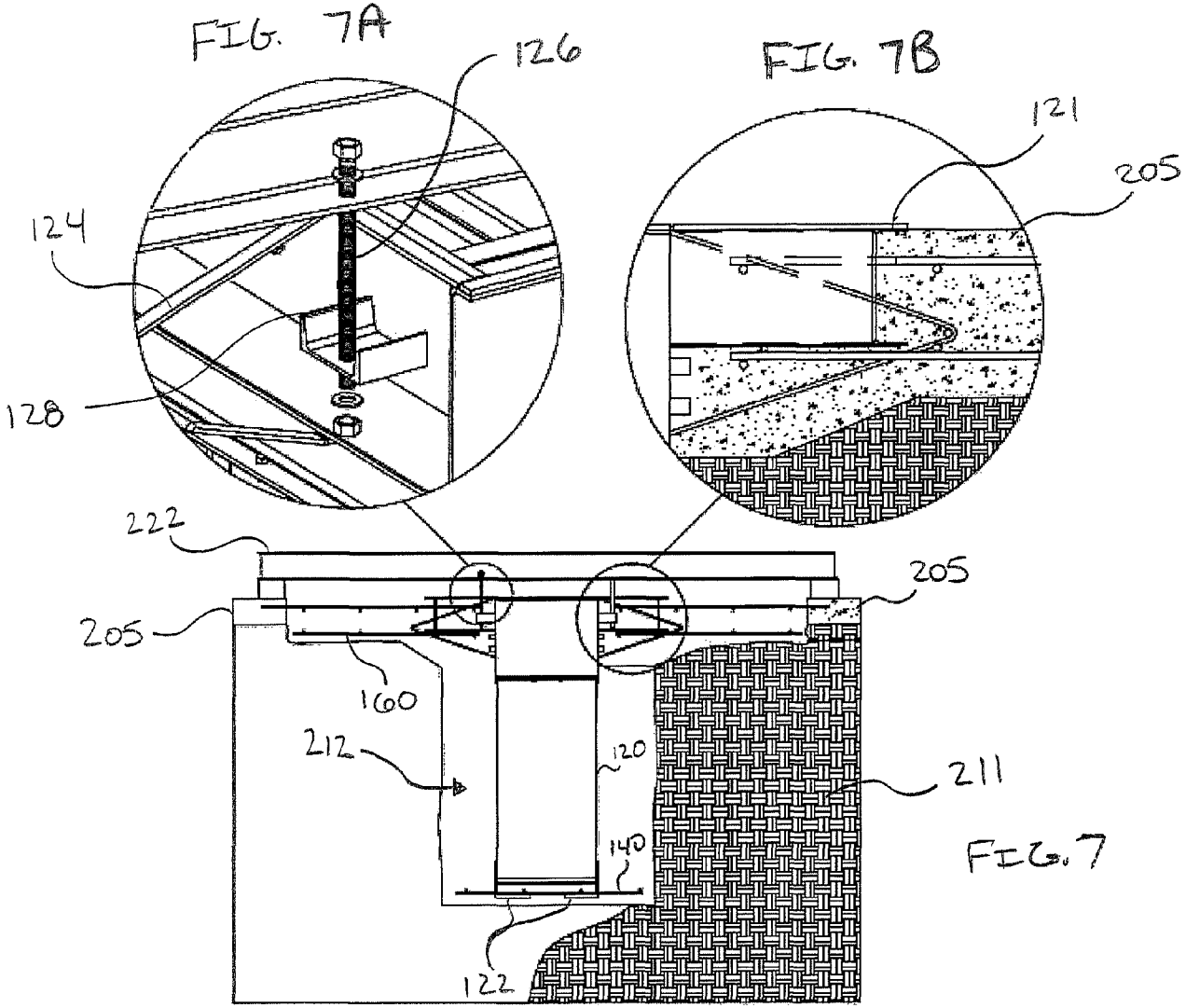
FIG. 7 depicts a front, cross-sectional view of a front housing and corresponding rebar systems of FIG. 5 during the installation step of the installation method of FIG. 6.
Figure 8:
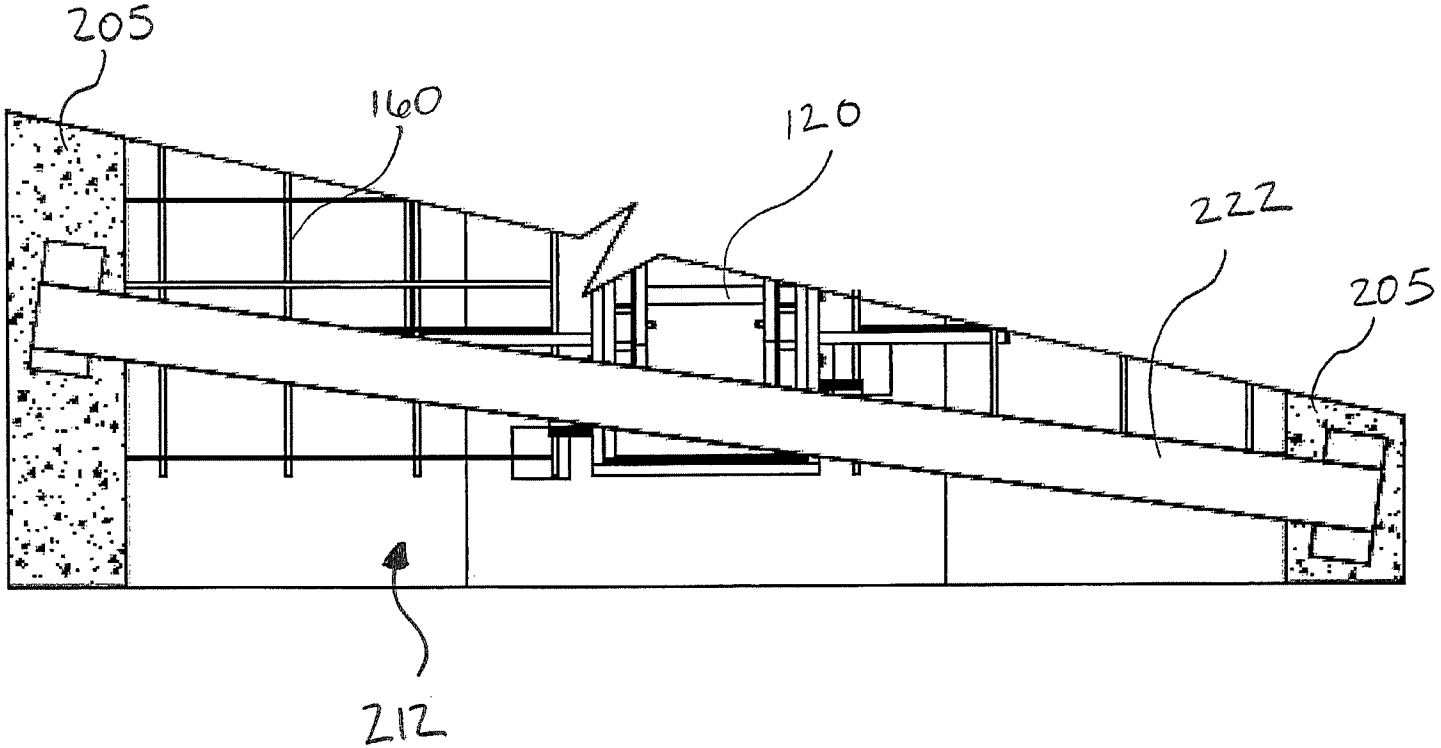
FIG. 8 depicts a top elevation view of the front housing and corresponding rebar systems of FIG. 7 during the installation step of the installation method of FIG. 6.

FIGS. 7-12 depict front housing 120 being installed using the housing installation method 200 described above. Specifically, FIGS. 7 and 8 depict front housing 120 during the installation step 220 of housing installation method 200. As shown, the pit 212 has been excavated (soil 211 is shown on one side of the pit 212) and the front housing 120 suspended within the pit 212. The front housing 120 is suspended from a support structure 222 that spans from one side of the existing floor 205 across the pit 212 to the other side of the existing floor 205. FIG. 7 also depicts upper rebar system 160 extending around the upper portion of the front housing 120 and lower rebar system 140 hanging from front housing 120 via rebar anchors 122.

FIG. 7A depicts an exemplary leveling bolt 126 and corresponding leveling gusset 128. As shown, the leveling gusset 128 is secured to an upper portion of the front housing 120. The leveling bolt 126 extends through the support structure 222 and the leveling gusset 128 such that the front housing 120 is adjustably coupled with the support structure 222 via leveling bolt 126. This functionality allows the front housing 120 to be leveled relative to the existing floor 205 during the installation step by tightening or loosening the leveling bolts 126. Any suitable number of leveling bolts 126 and leveling gussets 128 may be used.

As shown in FIG. 7B, the upper frame 121 of the front housing 120 may actually be set slightly above the grade of the existing floor (e.g., about ⅛" to about ¼" above grade).

Figure 9:
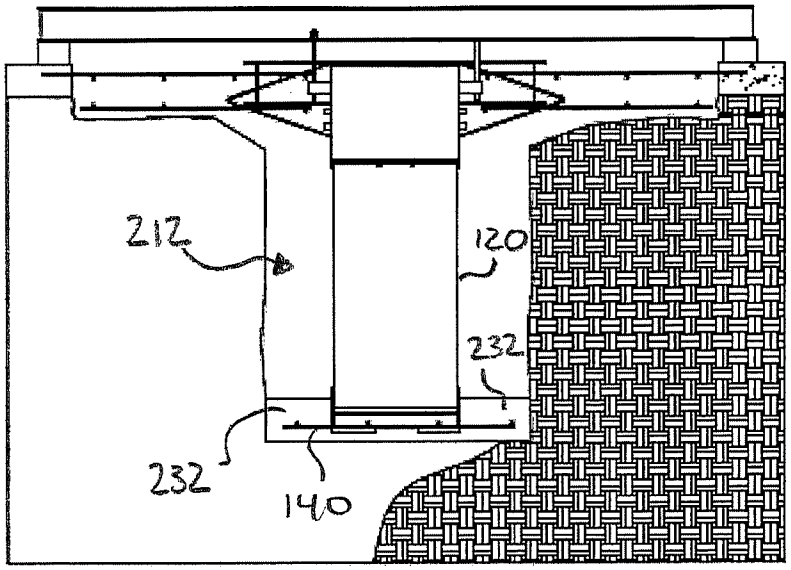
FIG. 9 depicts a front, cross-sectional view of the front housing and corresponding rebar systems of FIG. 7 during the pouring step of the installation method of FIG. 6.

FIG. 9 depicts front housing 120 during the pouring step 230 of the housing installation method 200. As shown, a concrete pad 232 has been poured around the front housing 120 at the bottom of the pit 212. A bottom portion of the front housing 120, the rebar anchors 122, and the lower rebar system 140 are embedded within the concrete pad 232.

Figure 10:
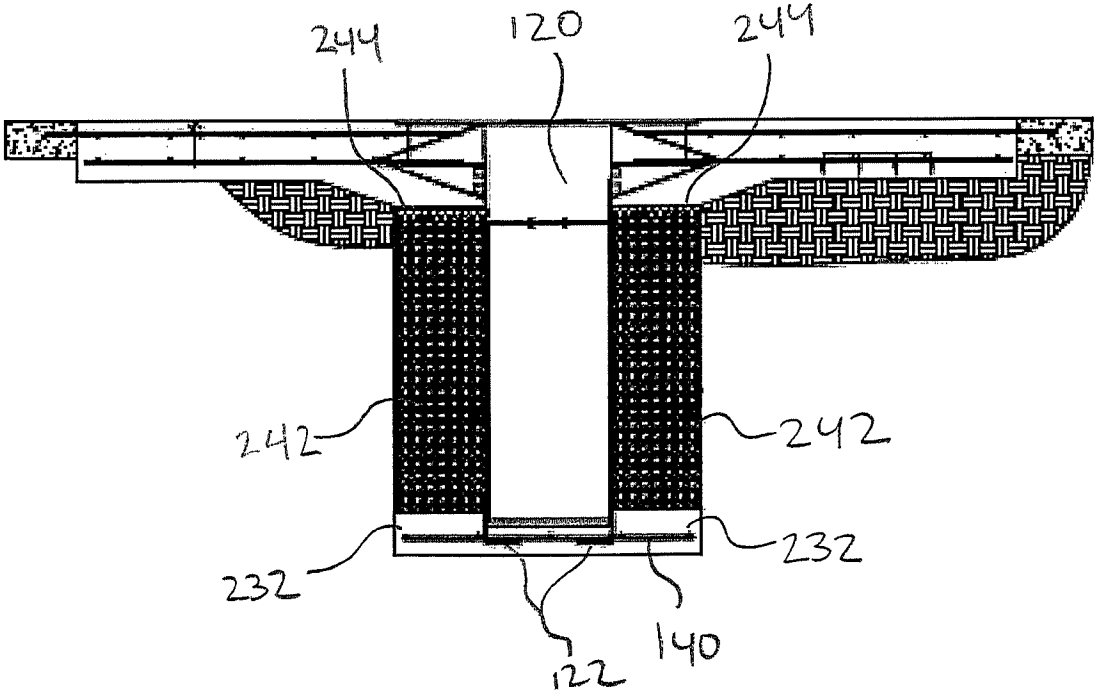
FIG. 10 depicts a front, cross-sectional view of the front housing and corresponding rebar systems of FIG. 7 during the finishing step of the installation method of FIG. 6.
Figure 11:
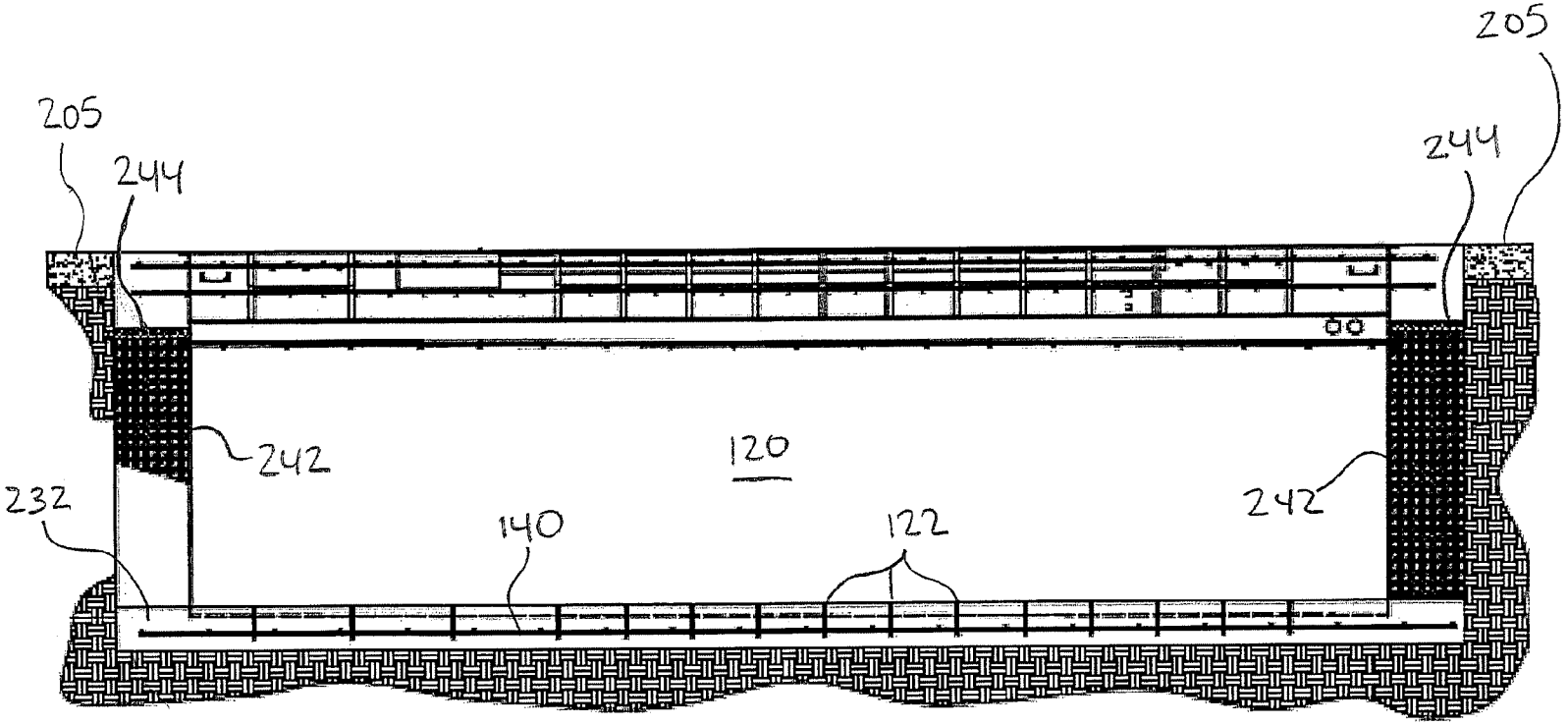
FIG. 11 depicts a side, cross-sectional view of the front housing and corresponding rebar systems of FIG. 7 during the finishing step of the installation method of FIG. 6.
Figures 12, 12A:
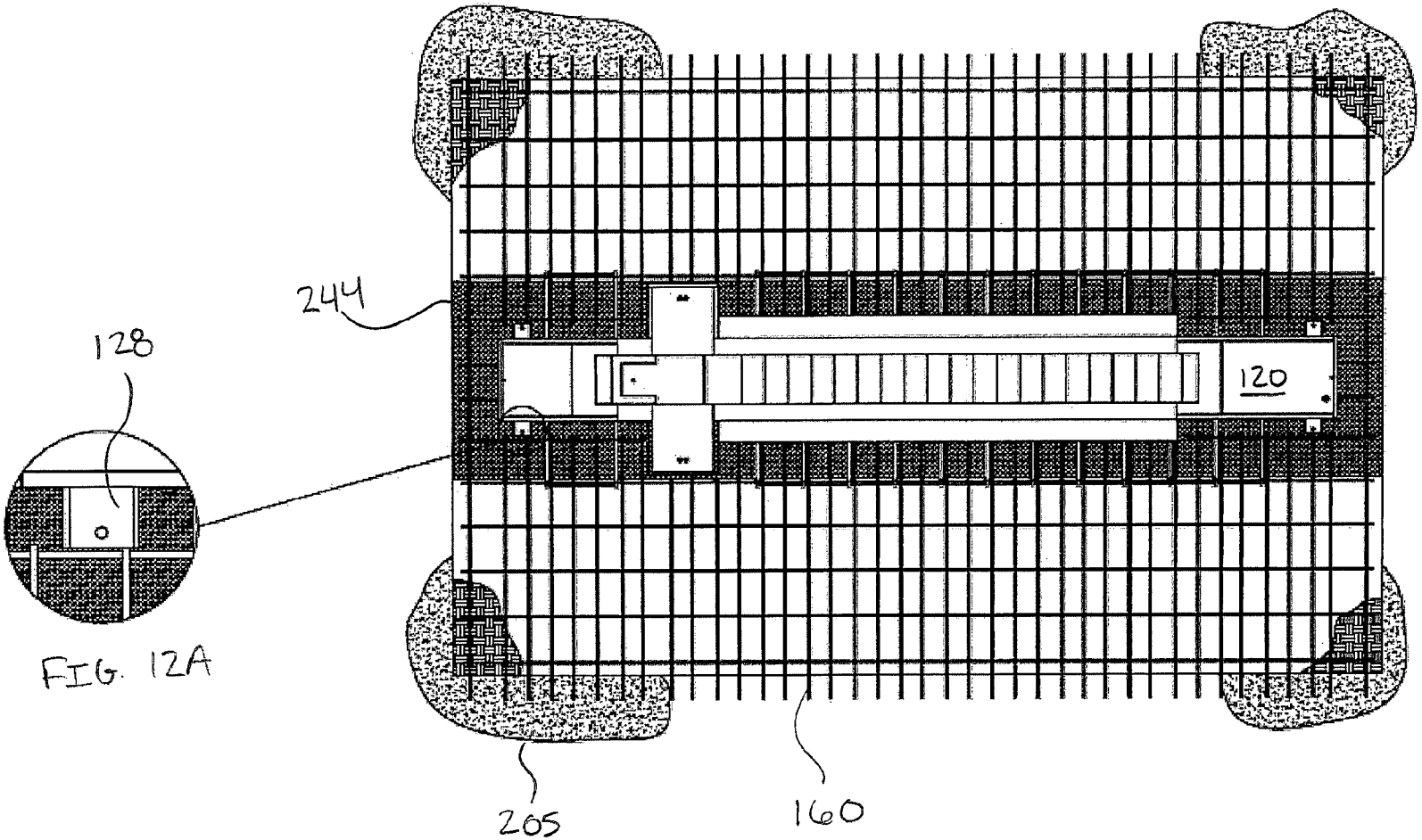
FIG. 12 depicts a top elevation view of the front housing and corresponding rebar systems of FIG. 7 during the finishing step of the installation method of FIG. 6.
FIG. 12A depicts a detailed view of a leveling gusset attached to the front housing of FIG. 7.

FIGS. 10-12 depict front housing 120 during the finishing step 240 of the housing installation method 200. As shown, backfill material 242 has been poured into the pit 212 around the front housing 120. In addition, insulating material 244 has been positioned around the front housing 120 on top of the backfill material 242. For clarity, the top layer of concrete poured around the front housing 120 on top of the insulating material 244 that embeds the upper rebar system 160 is not shown in FIGS. 10-12.

FIG. 12A depicts a detailed view of a leveling gusset 128. As shown in FIG. 12, a leveling gusset 128 is positioned at each corner of the front housing 120, for a total of four leveling gussets. As discussed above, any suitable number of leveling gussets may be used.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

We claim:

1. A method of installing an inground vehicle lift system, the inground vehicle lift comprising a first housing, wherein the first housing encloses a first set of components, where the first set of components are collectively configured to operate a first lift, wherein the first housing comprises a plurality of anchors configured to couple the first housing with a first lower rebar system, the method comprising the steps of:

(a) excavating an area to thereby create a first pit;

(b) coupling the first lower rebar system with the first housing via the plurality of anchors;

(c) attaching the first housing and the first lower rebar system to a support structure;

(d) suspending the first housing and the first lower rebar system from the support structure;

(e) lowering the first housing and first lower rebar system into the first pit, (f) pouring concrete into the first pit to a level such that the first lower rebar system is embedded within the concrete;

(g) allowing the concrete to partially cure such that the concrete has sufficient strength to support the first housing; and (h) detaching the first housing and the first lower rebar system from the support structure.

2. The method of claim 1, wherein the step of detaching the first housing and the first lower rebar system from the support structure is performed prior to the concrete fully curing.

3. The method of claim 1, wherein the step of detaching the first housing and the first lower rebar system from the support structure is performed after the concrete has fully cured.

4. The method of claim 1, wherein the method further comprises the step of backfilling the first pit.

5. The method of claim 1, wherein the method further comprises the step of installing insulation material within the first pit.

6. The method of claim 1, wherein the plurality of anchors extend form a bottom surface of the first housing.

7. The method of claim 1, wherein the plurality of anchors comprise L-shaped members.

8. The method of claim 1, wherein the method further comprises the step of leveling the first housing and the first lower rebar system prior to the step of pouring concrete into the first pit to a level such that the first lower rebar system is embedded within the concrete.

9. The method of claim 8, wherein the first housing further comprises a plurality of support members configured to couple the first housing with a first upper rebar system.

10. The method of claim 9, wherein the method further comprises the steps of coupling the first upper rebar system with the first housing via the plurality of support members and pouring concrete into the first pit to a level such that the first upper rebar system is embedded within the concrete.

11. The method of claim 8, wherein the step of leveling the first housing and the first lower rebar system comprises adjusting a position of the first housing and the first lower rebar system relative to the support structure.

12. The method of claim 8, wherein the first housing further comprises a plurality of leveling bolts, wherein the step of leveling the first housing and the first lower rebar system comprises tightening or loosening the leveling bolts.

13. The method of claim 1, wherein the inground vehicle lift further comprises a second housing, wherein the second housing encloses a second set of components, where the second set of components are collectively configured to operate a second lift, wherein the second housing comprises a plurality of anchors configured to couple the second housing with a second lower rebar system, the method further comprising the steps of:

(i) excavating an area to thereby create a second pit;

(j) coupling the second lower rebar system with the second housing via the plurality of anchors;

(k) attaching the second housing and the second lower rebar system to a support structure;

(l) suspending the second housing and the second lower rebar system from the support structure;

(m) lowering the second housing and second lower rebar system into the second pit, (n) pouring concrete into the second pit to a level such that the second lower rebar system is embedded within the concrete;

(o) allowing the concrete to partially cure such that the concrete has sufficient strength to support the second housing; and (p) detaching the second housing and the second lower rebar system from the support structure.

14. The method of claim 13, wherein the first pit and the second pit are the same pit.

15. The method of claim 13, wherein steps (a)-(h) and steps (i)-(p) are performed substantially simultaneously.

16. A method of installing an inground vehicle lift system, the inground vehicle lift comprising a housing, wherein the housing encloses components configured to operate a lift, wherein the housing comprises a plurality of anchors configured to couple the housing with a lower rebar system, the method comprising the steps of:

(a) excavating an area to thereby create a pit;

(b) lowering the lower rebar system into the pit, (c) attaching the housing to a support structure;

(d) suspending the housing from the support structure;

(e) lowering the housing into the pit, (f) coupling the lower rebar system with the housing via the plurality of anchors;

(g) pouring concrete into the pit to a level such that the lower rebar system is embedded within the concrete;

(h) allowing the concrete to partially cure such that the concrete has sufficient strength to support the housing; and (i) detaching the housing from the support structure.

17. The method of claim 16, wherein the method further comprises the step of leveling the housing and the lower rebar system prior to the step of pouring concrete into the pit to a level such that the lower rebar system is embedded within the concrete.

18. The method of claim 16, wherein the housing further comprises a plurality of support members configured to couple the housing with an upper rebar system, wherein the method further comprises the steps of coupling the upper rebar system with the housing via the plurality of support members and pouring concrete into the pit to a level such that the upper rebar system is embedded within the concrete.

19. A method of installing an inground vehicle lift system, the inground vehicle lift comprising a housing, wherein the housing encloses components configured to operate a lift, wherein the housing comprises a plurality of anchors, the method comprising the steps of:

(a) excavating an area to thereby create a pit;

(b) lowering the lower rebar system into the pit, (c) attaching the housing to a support structure;

(d) suspending the housing from the support structure;

(e) lowering the housing into the pit into a position such that the plurality of anchors are positioned adjacent to the lower rebar system but not attached thereto, (f) pouring concrete into the pit to a level such that the plurality of anchors and the lower rebar system are embedded within the concrete;

(g) allowing the concrete to partially cure such that the concrete has sufficient strength to support the housing and such that the housing is sufficiently coupled with the lower rebar system via the plurality of anchors positioned adjacent to the lower rebar system within the partially cured concrete; and (h) detaching the housing from the support structure.

20. The method of claim 19, wherein the housing further comprises a plurality of support members configured to couple the housing with an upper rebar system, wherein the method further comprises the steps of coupling the upper rebar system with the housing via the plurality of support members and pouring concrete into the pit to a level such that the upper rebar system is sufficiently embedded within the concrete.

* * * * *